US008452039B2

(12) United States Patent
Wright

(10) Patent No.: US 8,452,039 B2
(45) Date of Patent: May 28, 2013

(54) WEARABLE PERSONAL SOUND DELIVERY APPARATUS

(75) Inventor: Kenneth A. Wright, La Mesa, CA (US)

(73) Assignee: Mad Catz, Inc, San Diego, CA (US)

( * ) Notice: Subject to any disclaimer, the term of this patent is extended or adjusted under 35 U.S.C. 154(b) by 1211 days.

(21) Appl. No.: 12/299,340

(22) PCT Filed: May 3, 2007

(86) PCT No.: PCT/US2007/010823

§ 371 (c)(1), (2), (4) Date: Nov. 3, 2008

(87) PCT Pub. No.: WO2007/130565

PCT Pub. Date: Nov. 15, 2007

(65) Prior Publication Data

US 2009/0123000 A1 May 14, 2009

Related U.S. Application Data

(63) Continuation-in-part of application No. 11/417,788, filed on May 3, 2006, now abandoned.

(51) Int. Cl.
*H04R 25/00* (2006.01)

(52) U.S. Cl.
USPC ..... 381/370; 381/381

(58) Field of Classification Search
USPC ..... 381/309, 330, 373, 370, 381
See application file for complete search history.

(56) References Cited

U.S. PATENT DOCUMENTS

| | | | | |
|---|---|---|---|---|
| 5,677,964 | A * | 10/1997 | Sun | 381/385 |
| 7,313,246 | B2 * | 12/2007 | Miller et al. | 381/381 |
| 2008/0298626 | A1 * | 12/2008 | Dean | 381/381 |

* cited by examiner

*Primary Examiner* — Ramon Barrera
(74) *Attorney, Agent, or Firm* — Charmasson, Buchaca & Leach, LLP

(57) ABSTRACT

A personal sound delivery apparatus which can be worn by a person has speakers held close to the ears and does not include any insert into the auditory canal or any ear muff that could muffle or suppress other ambient sounds. In a preferred embodiment of the invention, a wireless speaker is anchored by an arcuate hanger shaped and dimensioned to rest behind the ear. The speaker is positioned within a range from 0 to 20 centimeters (0 to 8 inches) from the auditory canal and may be surrounded by baffles that focus the incoming sound toward the entrance of the auditory canal. In other embodiments, a pair of speakers are embedded into the collar of a garment, a scapulary that rests upon the shoulders, a clamp that is bridging the nape of the neck, in pendants suspended from the neck, or hidden in a pair of earrings.

8 Claims, 6 Drawing Sheets

WEARABLE PERSONAL SOUND DELIVERY APPARATUS

FIELD OF THE INVENTION

This invention relates to sound delivery systems and more specifically to portable, personal ones such as earphones.

BACKGROUND

The earphones of the prior art have been designed to deliver sound near or directly into the auditory canal at the exclusion of ambient sounds and noise. The purpose is to allow the wearer to listen to the selected speech, communication, or music undistracted and undisturbed by the environment. The shutting out of the ambient sounds and noise is accomplished by means of a muff that tightly surrounds the ear, by delivering the sound directly through a plug inserted into the auditory canal, such as the so-called "earbud" speaker, or by incorporating a speaker in a muff or helmet shell over or in front of each of the wearer's ears.

One of the problems associated with the delivery of sound either directly into the auditory canal or very close to it is a loss of sound fidelity. The pinna of each ear is configured to collect and direct sound into the auditory canal. Its twists and folds enhance high frequency sounds and help us to determine the location of the sound source. In a concert hall setting, we sense the music through vibrations that impact the entire bone structure surrounding the ear. Speakers inserted into the ear bypass these conditioning and sensing elements depriving the audiophile of a whole spectrum of auditory sensations.

More significantly, it has been suspected that the use of earbuds and other ear-inserted sound delivery devices pose a serious risk of hearing loss. A recent survey commissioned by the American Speech-Language-Hearing Association revealed that more than half of high school students in the United States reported at least one symptom of hearing loss due to too-loud and too-long use of MP3 and other types of music players using ear-inserted devices. It has been suggested that the devices that project the sound directly into the auditory canal are too harsh on the sensory cells, and that prolonged exposure to those harsh sounds are causing irreversible damage to the auditory organs.

Automobilists are often frustrated by a pedestrian or jogger wearing earphones who stays on the pavement in front of them because he cannot hear the incoming traffic due to the exclusory character of his earphones. In the past, if the user of a listening device had to also be able to hear ambient conversations and other sounds, he will be provided with only one earphone, forsaking the possibility of hearing stereophonic arrangements.

The prior art personal listening devices are also very conspicuous, unwieldy, cumbersome, and quite unsanitary.

The instant invention results from an attempt to eliminate the aforesaid problems and disadvantages associated with current listening devices, by offering a new generation of personal sound delivery apparatuses that do not obstruct the auditory canal or muffle ambient sounds, yet provide a reasonable degree of privacy and create a more natural musical environment.

With the advent of the extremely compact personal music players, a whole generation of audiophiles has become accustomed to work and play in a continuous private music environment delivered by the ubiquitous ear appendages constituted by earbud speakers. The invention offers elegant and safe methods and devices to listen to music the way it should be heard as an "around" sound, without shutting out the surrounding world or causing damage to one's hearing system.

SUMMARY

The instant embodiments comprise a variety of personal sound-delivering devices that can be worn by a person where dual or multiple speakers are held proximate the ears in the absence of obstruction of the user's auditory canals and muffling or complete suppression of the ambient sounds.

The points of sound delivery can be held within a range of 0 to 20 centimeters (0 to 8 inches) from the auditory canal of each of the user's ears. The speakers can be secured with a variety of anchoring means. In some embodiments, the anchoring means comprise an arcuate, filiform or tubular hanger shaped and dimensioned to fit behind an ear auricle. In some embodiments, the hanger has a prominence to engage the back of a person's lobule for greater stability. In other embodiments, the anchoring means comprise means for securing the speaker to a structure proximate a person's ear such as a clip resiliently clamped on an ear auricle or a stud engaged into a hole pierced through said auricle. In other embodiments, the anchoring means comprise a clip resiliently clamped on the user's nucha, a collar that is part of a garment worn by the user, a scapulary, a neck pendant, or other proximate article.

In some embodiments the arcuate hanger comprises a first end proximate the speaker and an open opposite end, wherein said speaker is located proximate to and to touch against a tragus. In some embodiments, the speaker has a convexly arcuate peripheral edge which follows the contour of the tragus. In some embodiments, the hanger comprises one or more bass ports oriented to aim bass frequency sounds toward the pinna.

In some embodiments the arcuate hanger comprises a tube having a first end proximate the speaker and an open opposite end, wherein said speaker is located proximate an ear lobule and said open end is located proximate the triangular fossa. Asperities are created on the internal wall of the tubular hanger in order to eliminate echoic distortions.

Any one of the various types of speakers may comprise a sound deflecting baffle shaped to focus sound emitting from the speaker toward the auditory canal.

In some embodiments, the hanger comprises a pair of tubes projecting from the speaker such as a hanger comprising a tube having an enlarged median section, and the speaker is lodged into an opening in said section.

Each speaker may consist of a wireless receiver such as a crystal receiver.

In some embodiments the anchoring means comprise an earring or an adhesive-coated pad. The anchoring means can also comprise a speaker enclosure having a slot, and a sheet-like object loosely inserted into said slot. That enclosure may be a table top pod of a small brooch that can be clipped to a book or wallet that the user may place in front on him on a plane seat, food tray or similar support.

The invention also offers in combination of the sound delivery apparatus a speaker loudness testing device comprising a laminated card or other enclosure, and, imbedded in said card, a microphone and a plurality of indicators selectively responsive to the output level of the microphone.

Each of the above-mentioned speakers may comprise a low frequency sub-speaker and a high frequency sub-speaker.

DESCRIPTION OF THE EXEMPLARY EMBODIMENTS

Figure 1:
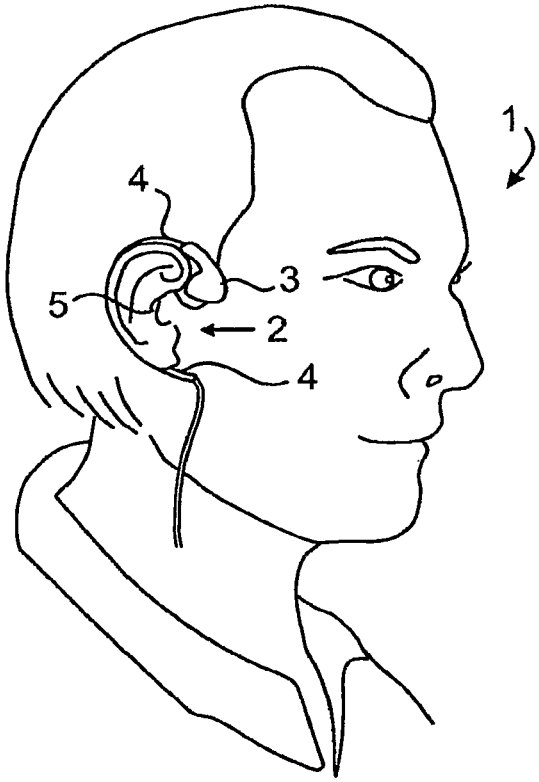
FIG. 1 is a perspective view of a person wearing an exemplary embodiment of a personal sound delivery system.

Referring now to FIG. 1, there is shown a person 1 wearing a personal sound delivery apparatus 2, that allows that person to listen to a recording or live communication under realistically natural conditions, while being able to perceive other ambient sound and even converse with another person. The apparatus comprises a miniature speaker 3 of the type commonly called "earbud" mounted at the end of an arcuate hanger 4 shaped and dimensioned to fit snugly behind one of the person's ears in such a way that the sound waves emanating from the speaker 3 are directed toward the ear meatus 5, that is the person's auditory canal. While only one speaker is illustrated on the drawing, it must be understood that the opposite ear is also fitted with a similar one. The speaker 3 may be held in a choice of various orientations. However, for best results, the point of sound delivery should be positioned within a range of 0 to 20 centimeters (0 to 8 inches) from the entrance of the auditory canal at a spot where it will not block ambient sounds. The point of sound delivery may be the speaker diaphragm or the end of a sound delivery tube baffle or other sound conducting device attached to the speaker. The hanger 4 is preferably tubular and made from metal or rigid plastic material. Vibrations from the speaker can also be conveyed by the hanger to the bone structure surrounding the ear.

Figure 2:
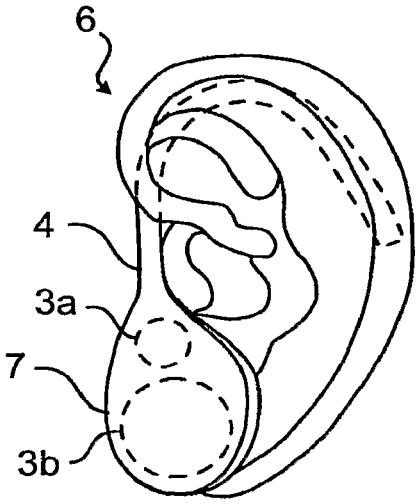
FIG. 2 is a frontal view of an alternate dual speaker and hanger combination.

In a first alternate embodiment 6 illustrated in FIG. 2, a high frequency sub-speaker 3*a* and a low frequency sub-speaker 3*b* shown in dotted lines are packaged in a pod 7 held by a hanger wire 4 similar to the one shown in FIG. 1.

Figure 3:
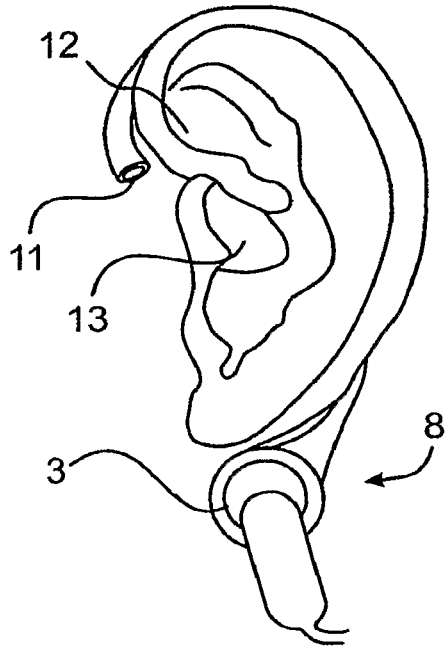
FIG. 3 is a frontal view of a second alternate embodiment of the sound delivery system attached to a ear.
Figure 4:
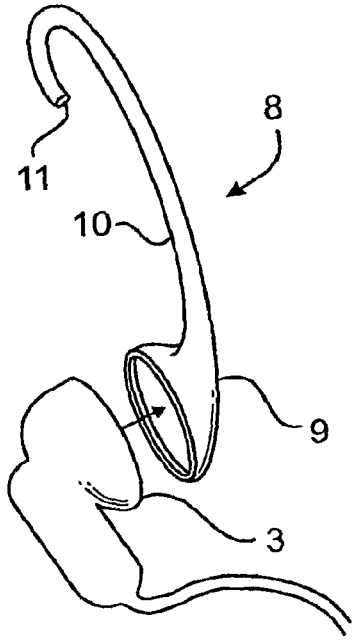
FIG. 4 is an exploded view of the device of FIG. 3.

In the sound delivery device 8 illustrated in FIGS. 3 and 4, an earbud speaker 3 is force-inserted or snapped into an adaptor 9 consisting of a slightly resilient cup or funnel engaging a tubular hook hanger 10 having an open opposite end 11 positioned proximate the triangular fossa 12. The hanger is shaped to direct the sound waves out of the open end 11 toward the entry of the auditory canal 13. The hanger 10 is preferably made of metal or other hard material for improved sound transmission.

The above-mentioned earbud-type of miniature speakers are part of most standard brand of audio devices, and are commercially available under a number of manufacturers, brand names and model numbers including CUI, Inc. GCO series; Panansonic EAS-G series; and Knowles Acoustics, model ED-3619, from Digi-Key Corporation of Thief River Falls, Minn., U.S.A.

Figure 5:
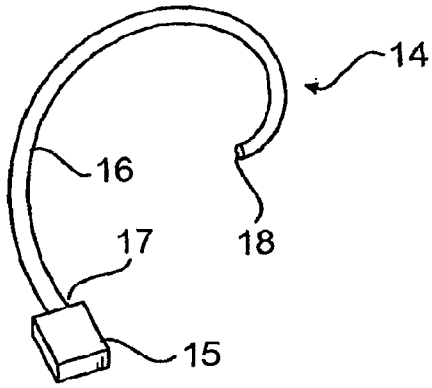
FIG. 5 is a third alternate embodiment of the sound delivery system.
Figure 6:
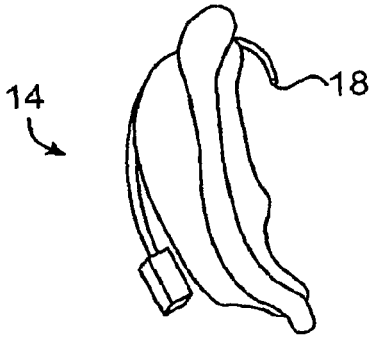
FIG. 6 is a perspective view of the device of FIG. 5 hung over an ear.

In the embodiment 14 of the sound delivery system illustrated in FIGS. 5 and 6, the speaker 15 consists of a wireless crystal receiver/speaker combination. Such a device includes a traditional type of crystal receiver feeding a miniature speaker. The receiver may deliver enough current to operate the speaker without battery power. These components are commercially available from Knowles Acoustics under part number ED-3619 or Digi-Key corporation of Thief River, Minn. under part number 4423-1059-ND. The tubular hanger 16, similar to the one described in connection to the embodiment of FIG. 3 has one end mated to the face of the speaker 17 and an open opposite end 18.

Figure 7:
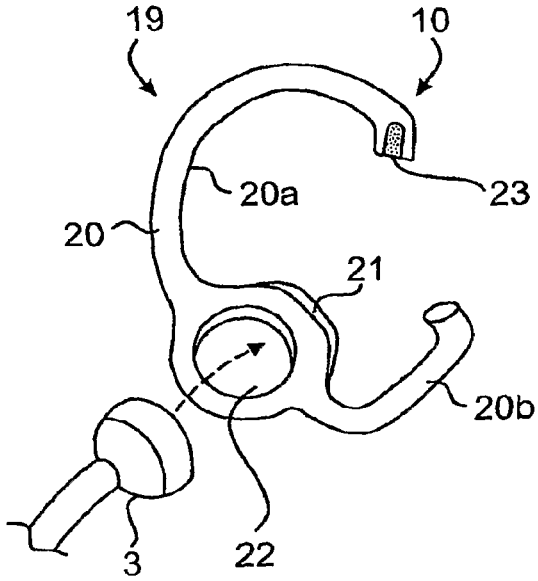
FIG. 7 is an exploded view of a fourth alternate embodiment of the sound delivery system.

In the embodiment 19 of FIG. 7, a tubular hanger 20 comprises two tubes 20*a*, 20*b* projecting from the speaker. More specifically, a tubular hanger has an enlarged median section 21. An opening 22 in the enlarged section is dimensioned to accommodate and tightly hold an earbud speaker 3 of the type previously described. The hanger 20 is shaped and dimensioned to conveniently nest behind the auricle of one of the user's ears. It can be made of a malleable plastic that allows for custom fitting of the device to the particular anatomy of the user's ear, and to conveniently orient the open end of the tube toward the auditory canal. As illustrated in the cut-out portion of the tube, the interior wall is preferably gnarled by asperities or rugosities 23 in order to reduce the swirl and echo effect often associated with tubular structures. Giving the hanger tube an oval or flattened rather than circular cross-section can also improve the sound fidelity by providing a larger cross-section for a given amount of bulkiness and level of comfort.

Figure 8A:
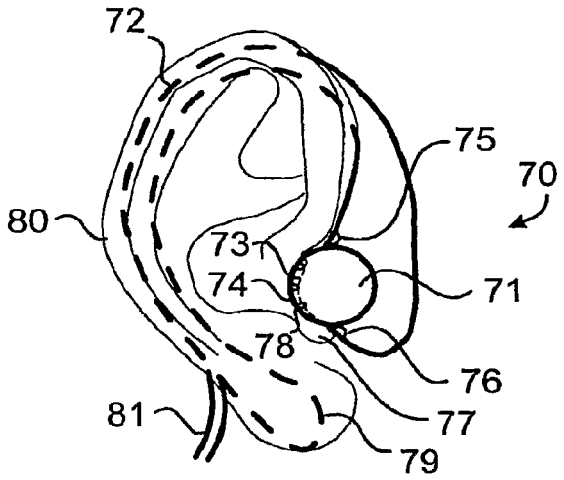
FIG. 8A is an perspective view of a fifth alternate embodiment of the sound delivery system.

In the embodiment 70 of FIG. 8A, a miniature speaker 71 is mounted at one end of an arcuate hanger 72 (shown in dashed lines behind the pinna) shaped and dimensioned to fit snugly behind one of the person's ears 80 in such a way to position the speaker touching against the person's tragus having a curved edge 73 shown behind the speaker in dashed lines. The shape of the speaker is selected to provide a convexly arcuate peripheral edge 74 which follows the typically curved shape of the tragus. This allows the tragus to block the direct air path between the meatus to a significant portion of the speaker. In this way, the person will hear more sounds reflecting and traveling through the person's pinna rather than on a direct path from speaker to meatus. One or more bass ports 75,76 are provided to convey bass frequencies away from the tragus and more directly toward the meatus or structures immediately surrounding the meatus such as the cavum conchae. A first bass port 75 is located at the lower terminus of the arcuate peripheral edge 74 and proximate the intertragic notch 77. A second bass port is optionally provided at the upper terminus of the arcuate peripheral edge 74. The overall dimensioning of the speaker and hanger are selected to allow a person to plug their ears by inserting a finger into the meatus without disturbing the placement of speaker 71. Alternately, one or more holes 78 can be formed into the arcuate peripheral edge 74 of the speaker 71 to increase the level of treble frequencies aimed more directly toward the meatus. Alternately, a prominence 79 is formed at the opposite end of the arcuate hanger 72 and oriented to contact the person behind the lobule, thereby providing for a more secure placement of the speaker and hanger. A wire 81 drives the speaker, or it may be wireless.

Figure 8B:
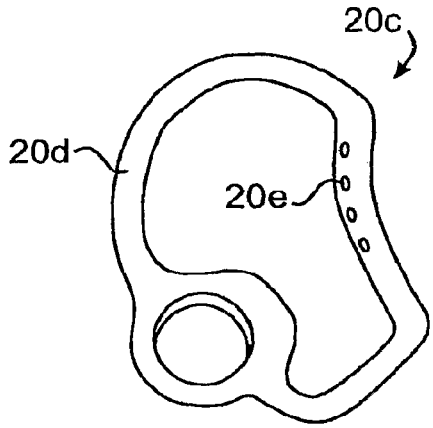
FIG. 8B is an perspective view of a sixth alternate embodiment of the sound delivery system.

In the embodiment 20*c* illustrated in FIG. 8B, the hanger tube 20*d* forms a closed loop providing greater stability on the ear. At least one opening 20*e* is formed through the wall of the hanger tube to provide a sound delivery point. The location of the opening can be selected to direct the sound toward the auditory canal. A plurality of spaced apart openings can be sized and located to spread the sound delivery point across different portions of the ear anatomy in order to provide a more natural sound experience to the user. The closed loop hanger can also be shaped to provide a more aesthetically appealing hoop type earring shape.

Figure 9:
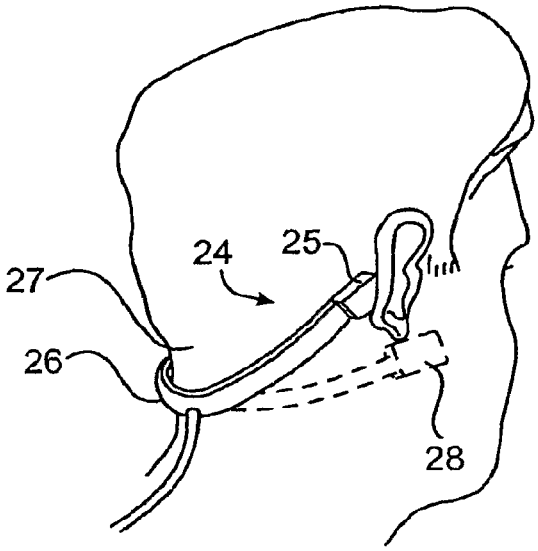
FIG. 9 is a perspective view of a seventh alternate embodiment of the sound delivery system worn by a person.

In the alternate embodiment 24 illustrated in FIG. 9, a pair of speakers 25 are mounted at opposite ends of a resilient plastic clip 26 shaped and dimensioned to bridge or clamp over the nucha 27, that is the nape of the neck so as to position the speakers 25 either behind the ears or immediately below as illustrated at 28 in dotted lines on the drawing. Ear hangers may also be provided to better secure and stabilize the device.

Figure 10:
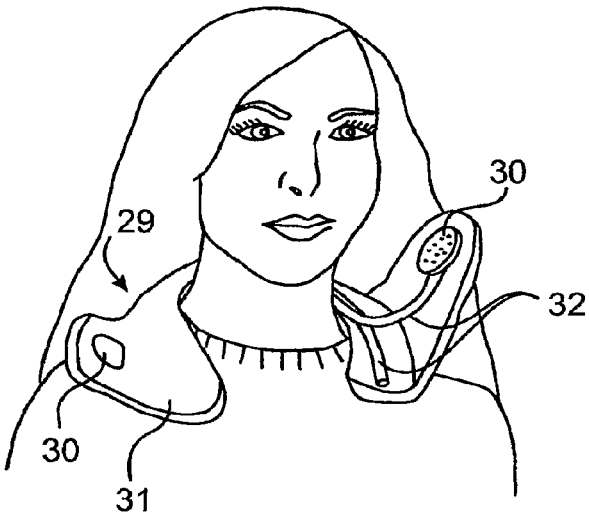
FIG. 10 is a perspective view of a person wearing a eighth alternate embodiment of the sound delivery system.

In the alternate embodiment 29 illustrated in FIG. 10, a pair of speakers 30 are embedded into a scapulary 31 which rests over the shoulders of the user. The scapulary can have a fabric cover and may be weighted with metal beads or provided on its under surface with hook-and-vane fabric fasteners to prevent it from slipping away from the shoulder during abrupt movements. The speakers are preferably located just below the ears. The body of the scapulary may include or consist of a frame 32 made of flexible wire or other goose-neck material that can be conveniently folded as shown on the user's left shoulder in order to properly orient the speaker 30 toward the ear.

Figure 11:
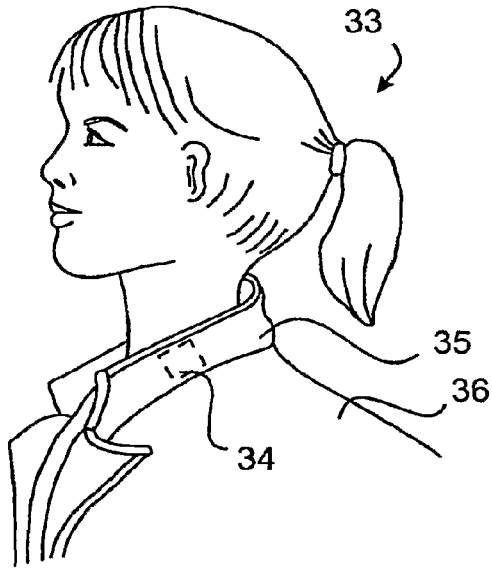
FIG. 11 is a perspective view of a person wearing a ninth alternate embodiment of the sound delivery system.

In the alternate embodiment 33 illustrated in FIG. 11, a pair of speakers 34 are sewn or otherwise fixed into the collar 35 of a garment 36 worn by the user. The speakers are preferably located just below the ears with the front of the speakers, facing up so that when the upper collar 35 is lifted as shown on the drawing, the speaker is aimed toward the ears.

Figure 12:
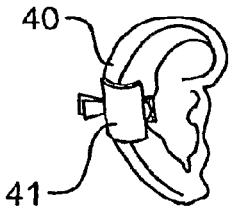
FIG. 12 is a perspective view of a tenth alternate embodiment of the sound delivery system clipped to an ear.
Figure 13:
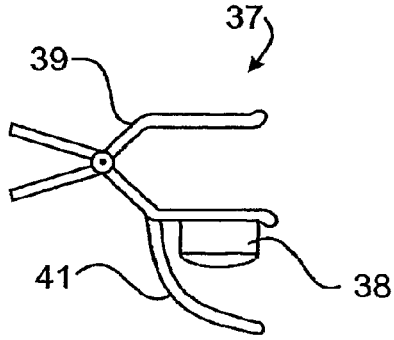
FIG. 13 is a top plan view of the device of FIG. 12.

In the embodiment 37 illustrated in FIGS. 12 and 13, the speaker 38 is mounted on a clip 39 which can be attached to the helix 40 of a ear as illustrated in FIG. 12, to a strand of hair, to the brim of a hat, or to any convenient spot proximate the temples or ears. The clip is provided with a parabolic sound deflecting baffle 41 which projects over the face of the speaker 38 in order to focus the sound waves toward the opening of the auditory canal. It must be understood that any one of the other embodiments disclosed herein can benefit from the addition of one or more sound-deflecting baffles.

Figure 14:
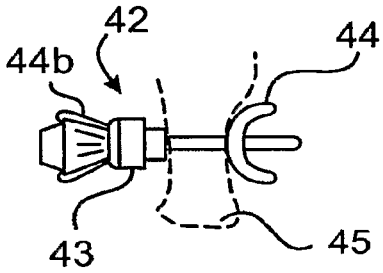
FIG. 14 is a side view of a wireless speaker mounted within a stud earring.
Figure 15:
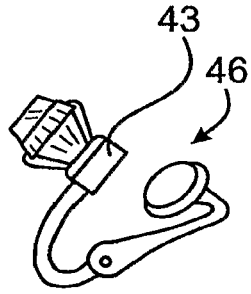
FIG. 15 is a perspective view of a wireless speaker mounted in a clipping earring.

In the embodiment 42 illustrated in FIG. 14, a wireless speaker 43 is incorporated within a stud-type earring 44 engaged through an opening in the lobule part of the auricle. The decorative portion 44*b* of the earring can be formed into a sound-directing baffle to focus sound toward the auditory canal. Alternately, the speaker 43 can be incorporated into a clip-type earring 46. The speaker can also be held on a pad having an adhesive backing, or even imbedded under the skin.

Figure 16:
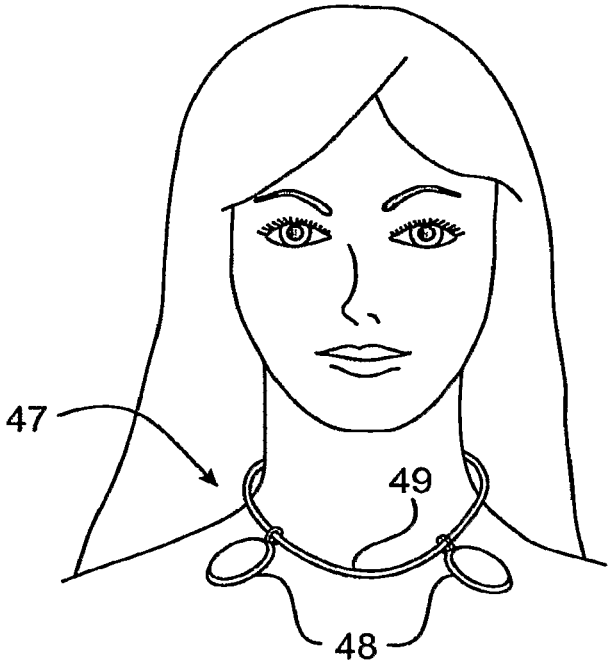
FIG. 16 is a perspective view of a person wearing a eleventh embodiment of the sound delivery system.

In the embodiment 47 illustrated in FIG. 16, speakers are imbedded into pendants 48 hanging from a lanyard, chain or necklace 49 around the neck of the user.

Figure 17:
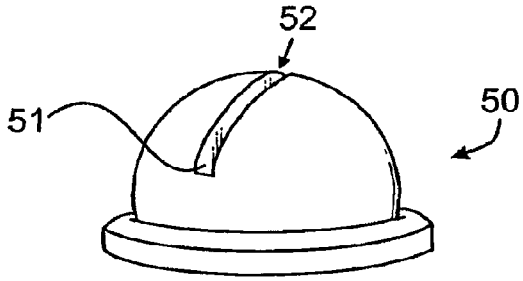
FIG. 17 is a perspective view of a desktop speaker base.
Figure 18:
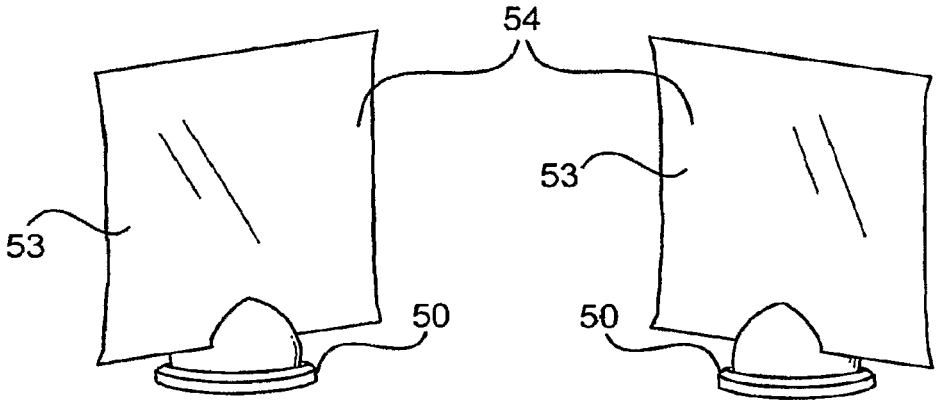
FIG. 18 is a perspective view of a pair of speaker-bases of FIG. 17 equipped with a sheet-like diaphragm.

Illustrated in FIGS. 17 and 18, is a desktop-speaker 50 whose vibrating membrane 51 is located within a slot 52 cut across the hemispheric top of the speaker enclosure. When a piece of paper, cardboard or any other sheet-like object 53 is inserted within the slot 52 or otherwise held against the speaker membrane, the sound delivered by the speaker membrane is amplified by the vibration of the object 53. A pair of such speakers 54 positioned on a work surface can provide a convenient, inconspicuous and effective personal sound delivery system.

It should be understood that each above-described embodiment of a sound delivery apparatus may include a high and low frequency dual speaker.

Figure 19:
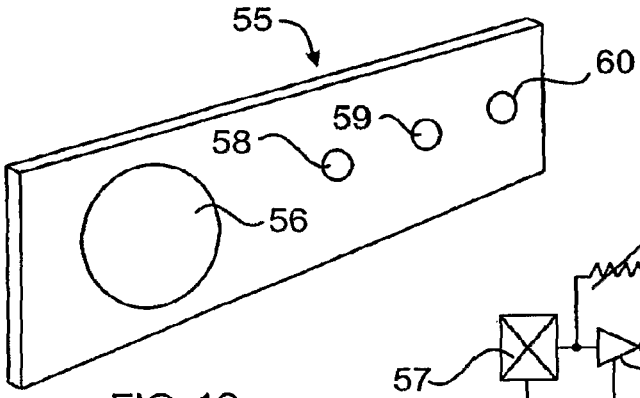
FIG. 19 is a perspective view of a loudness detector.
Figure 20:
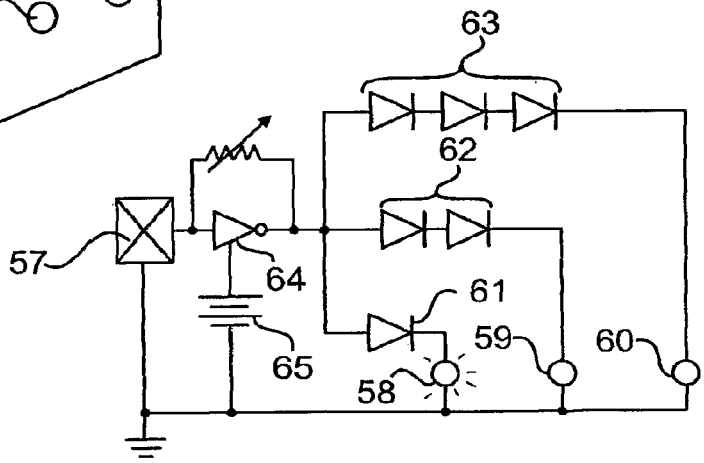
FIG. 20 is an electrical diagram of the loudness detector of FIG. 19.

Illustrated in FIGS. 19 and 20, is a sound loudness detecting device imbedded into a laminated card 55 which can be used to verify that the audio output of a speaker does not exceed safety norms, typically 62 to 95 decibels. It must be understood that the device could be packaged in pocket clip or various other enclosures. The card comprises a microphone 56 dimensioned to match the front of an earbud or other miniature speaker. The microphone consists of a piezoelectric sensor 57 commercially available under the PANASONIC brand, part number WM-63GCT. The sensor, when excited by sound, provides enough output power to drive one or more of a plurality of LED indicators 58-60 selectively and proportionally responsive the amplitude of the output signal. A set of one or more diodes 61-63 mounted in series between the sensor 57 and one of the indicators becomes conductive when the output of the sensor exceeds the bias voltage of the series of diodes. Accordingly, a low, safe sound output may cause only the first sensor 58 to light. A higher, borderline output will cause the median sensor 59 to light. And, excessive and dangerous sound output will cause the third sensor 60 to light. If needed, the output of the piezoelectric microphone can be boosted by a gain-adjustable buffer amplifier 64 powered by a small battery 65. After calibration, the card can be used to verify that the output of any of the speakers in the previously described embodiments of the invention does not exceed safe limits prior to its use.

While the preferred embodiments of the invention have been described, modifications can be made and other embodiments may be devised without departing from the spirit of the invention and the scope of the appended claims.

The invention claimed is:

1. A personal sound delivery apparatus worn by a person, which comprises:

at least one speaker; and anchoring means for holding said speaker sound delivery point proximate an ear of said person, in the absence of obstruction of the auditory canal and muffling of ambient sounds;

wherein said speaker sound delivery point is held within a range of about 0 to 20 centimeters (0 to 8 inches) from the auditory canal of said person's ear;

wherein said anchoring means comprise an arcuate hanger shaped and dimensioned to fit behind an ear auricle and position said speaker against a users tragus; and, wherein said speaker is shaped to have a convexly arcuate peripheral edge which follows the curved edge contour of said tragus.

2. The apparatus of claim 1, wherein said anchoring means comprise an arcuate tubular hanger shaped and dimensioned to fit behind an ear auricle.

3. The apparatus of claim 1, wherein said hanger further comprises at least one bass port oriented to aim bass frequency sounds toward a user's pinna.

4. The apparatus of claim 1, wherein said anchoring means comprise means for securing said speaker to a structure proximate an ear.

5. The apparatus of claim 4, wherein said means for securing comprise a prominence oriented to behind a person's lobule.

6. The apparatus of claim 1, wherein said speaker comprises a wireless receiver.

7. The apparatus of claim 6, wherein said receiver comprises a crystal receiver.

8. A personal sound delivery apparatus worn by a person, which comprises:

a pair of miniature speakers;

a pair of arcuate hangers each being shaped and dimensioned to fit behind an ear auricle and position each of said speakers against a users tragus, and hold the sound delivery points of said speakers within a range of 0 to 20 centimeters (0 to 8 inches) from the entrance of auditory canals of both of said person's ears without obstructing said auditory canals and muffling or suppressing ambient sounds; and, wherein each of said speakers is shaped to have a convexly arcuate peripheral edge which follows the curved edge contour of said tragus;

whereby said person can listen to sounds emanating from said speakers, and, at the same time, converse with another person and hear other ambient sounds.

* * * * *